US005292114A

United States Patent [19]

McConnell

[11] Patent Number: 5,292,114

[45] Date of Patent: Mar. 8, 1994

[54] AUTOMATIC FEEDER MODULE FOR A MAIL SORTING SYSTEM

[75] Inventor: William P. McConnell, Baltimore, Md.

[73] Assignee: Westinghouse Electric Corp., Pittsburgh, Pa.

[21] Appl. No.: 766,731

[22] Filed: Sep. 27, 1991

[51] Int. Cl.[5] ..... B65H 3/04; B65H 9/00; B65H 3/62

[52] U.S. Cl. ..... 271/34; 271/2; 271/241; 271/146; 271/150; 271/157

[58] Field of Search ..... 271/2, 10–12, 271/34, 145, 146, 149, 150, 153, 155, 157, 122, 125, 236, 241

[56] References Cited

U.S. PATENT DOCUMENTS

| | | | |
|---|---|---|---|
| 3,598,400 | 8/1971 | Nelson | 271/150 |
| 3,749,395 | 7/1973 | Bazzarone et al. | 271/34 |
| 3,759,509 | 9/1973 | Peterson | 271/150 |
| 3,771,783 | 11/1973 | McInerny | 271/125 |
| 3,894,732 | 7/1975 | Müller | 271/150 |
| 3,966,193 | 6/1976 | Storace et al. | 271/150 |
| 3,981,493 | 9/1976 | Klappenecker et al. | 271/10 |
| 3,991,998 | 11/1976 | Banz et al. | 271/125 |
| 4,018,434 | 4/1977 | Mitchell et al. | 271/122 |
| 4,295,645 | 10/1981 | Nahar et al. | 271/146 |
| 4,302,000 | 11/1981 | Frank | 271/34 |
| 4,331,328 | 5/1982 | Fasig . | |
| 4,566,685 | 1/1986 | Irvine et al. | 271/150 |
| 4,586,705 | 5/1986 | Satoh et al. | 271/125 |
| 4,634,111 | 1/1987 | Frank . | |
| 4,666,140 | 5/1987 | Godlewski | 271/125 |
| 4,801,134 | 1/1989 | Yokoyama et al. | 271/125 |
| 4,884,796 | 12/1989 | Daboud . | |
| 4,955,596 | 9/1990 | Ricciardi | 271/150 |
| 5,092,574 | 3/1992 | Braen et al. | 271/2 |
| 5,092,575 | 3/1992 | Ramsey | 271/157 |
| 5,116,039 | 5/1992 | Braen et al. | 271/2 |
| 5,129,642 | 7/1992 | Svyatsky et al. | 271/122 |

FOREIGN PATENT DOCUMENTS

| | | | |
|---|---|---|---|
| 289256 | 4/1991 | Fed. Rep. of Germany | 271/241 |

*Primary Examiner*—H. Grant Skaggs
*Attorney, Agent, or Firm*—Norman A. Nixon

[57] ABSTRACT

An automatic feeder module for a mail sorting system including a cabinet having first and second ends and an upper planar surface, a conveyor belt having an upper run travelling along the upper surface of the cabinet, a drive plate linearly driven along the conveyor belt at the same speed as a conveyor belt and having a forward side and a rearward side, means for driving the conveyor belt and the drive plate at the same speed, and a singulator assembly including pick-off means against which a stack of mail is pressed by the drive plate and the conveyor belt, and a stack pressure switch for turning the driving means on and off to maintain a predetermined stack pressure against the pick-off means.

10 Claims, 9 Drawing Sheets

AUTOMATIC FEEDER MODULE FOR A MAIL SORTING SYSTEM

BACKGROUND OF THE INVENTION

1. Field of the Invention

The present invention relates generally to mail sorting machinery and, more specifically, to an automatic feeder module for a mail sorting system, with improved singulator and mail conveyor components.

2. Description of the Related Art

Automatic feeders for mail sorting systems are known. Generally, a stack of mail is fed to a singulator mechanism which attempts to ensure that only one piece of mail is fed at a time.

It is important for a mail sorting system that only one piece of mail be fed at a time. A system controller relies on successive pieces of mail having a predetermined spacing therebetween as they move through the induction subsystem. Various machines have been introduced to ensure single-piece feeding.

U.S. Pat. No. 4,331,328 describes a document feeder that employs a variable speed servo which drives a group of low speed rollers and a group of high speed rollers while maintaining a constant speed ratio between the two groups. A natural gap develops between first and second documents in a track of the feeder between the time the first document and the second document pass from control by the group of low rollers into control by the group of high speed rollers. A document hopper receives a stack of documents which are substantially of the same size and thickness while a flag urges the stack of documents towards the feeder rollers.

U.S. Pat. No. 4,634,111 describes a friction separation device for an automatic envelope feeder in which a stack of mail is conveyed on a conveyor belt towards a rocker pulley. Sensors detect the amount of pressure against the rocker pulley so as to control the feed rate of the conveyor 7.

U.S. Pat. No. 4,884,796 describes a singulator for a document feeder. The feeder includes a movable gate which when in a closed position sets as a fixed guide for properly aligning a stack of documents in a magazine and which when in a release position moves out of contact with the documents to relieve the friction force between the documents. The gate is moved to the released position simultaneously with the start of the pick-off means of the singulator whereby the friction force between the first and second document is substantially reduced at the instance the first document is picked off the stack.

The aforementioned automatic feeders with singulator and/or conveyor mechanisms are not particularly suitable for handling a variety of mail sizes and thicknesses. Thus, a need exists for an automatic feeder module which can effectively and reliably feed mail pieces of varying size one at a time into a mail induction subsystem of a mail sorting system.

SUMMARY OF THE INVENTION

An object of the present invention is to provide an automatic feeder module for a mail sorting system which is capable of feeding mail pieces one at a time at regularly spaced, controlled and predetermined intervals.

Another object of the present invention is to provide a conveyor component of an automatic feeder module which is capable of being constantly loaded by an operator so as to provide continuous on-line operation of the mail sorting system.

Another object of the present invention is to provide a singulator for an automatic feeder module which ensures that only one piece of mail is fed into a mail induction subsystem at a time, even though mail of different sizes and shapes may be fed therethrough.

These and other objects of the invention are met by providing an automatic feeder module for a mail sorting system which includes a cabinet having first and second ends and an upper planar surface, a conveyor belt having an upper run travelling along the upper surface of the cabinet, a mail tray pivotally mounted at the first end of the cabinet on the upper surface thereof, means for tilting and vibrating the mail tray, a drive plate linearly driven along the conveyor belt at the same speed as the conveyor belt and having a forward side and a rearward side, means for driving the conveyor belt and the drive plate at the same speed, and a singulator assembly including pick-off means against which a stack of mail is pressed by the drive plate and the conveyor belt, and a stack pressure switch for turning the drive means on and off to maintain a predetermined stack pressure against the pick-off means.

These and other features and advantages of the invention will become more apparent with reference to the following detailed description and drawings.

DETAILED DESCRIPTION OF THE PREFERRED EMBODIMENTS

Figure 1:
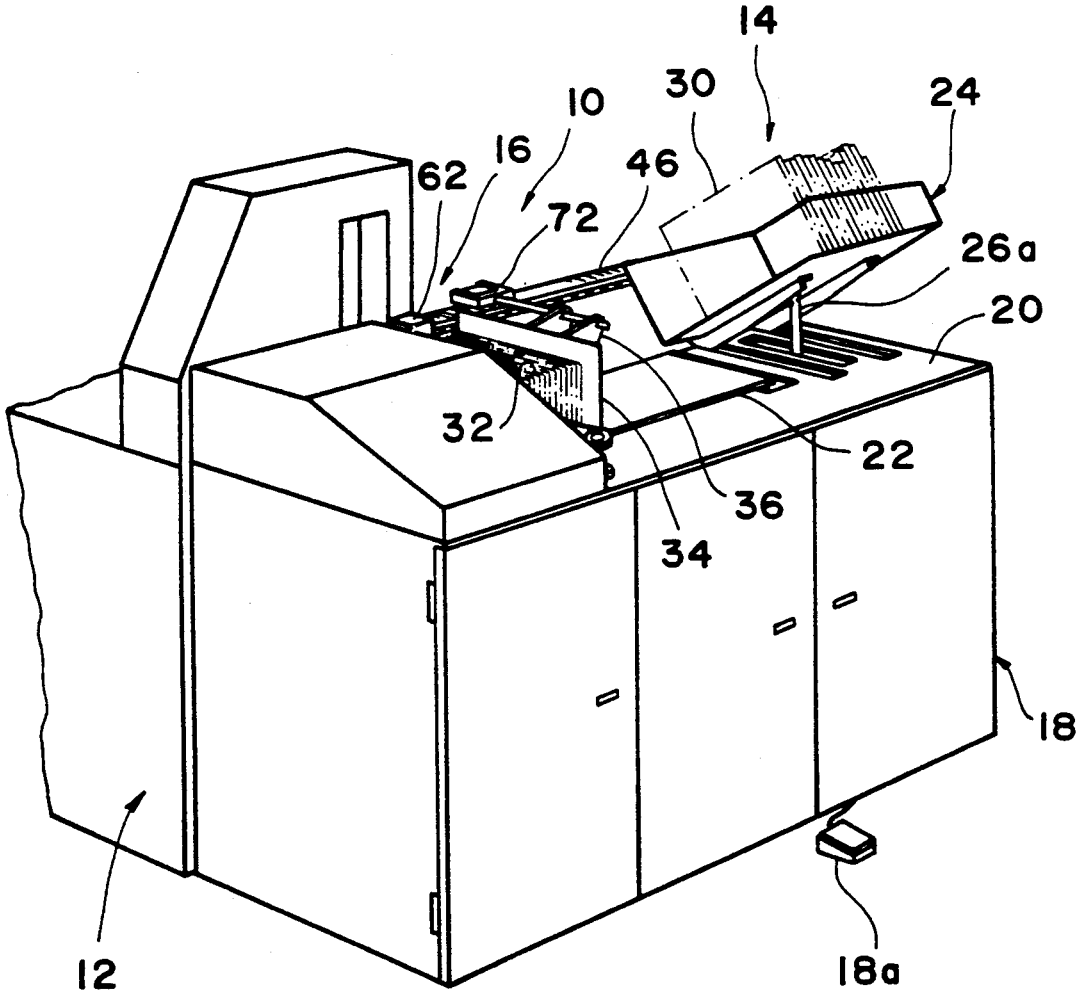
FIG. 1 is a perspective view of an automatic feeder module according to the present invention.

Referring to FIGS. 1, 1(*a*) and 2, an automatic feeder module for a mail sorting system is generally referred to by the numeral 10. The module 10 is adapted to be coupled to an output-leveler module 12 of the mail sorting system. The output-leveler module 12 is not illustrated in detail, but includes a leveler section and a catch-up section. The leveler section ensures that each piece of mail fed into the output-leveler module 12 is level with respect to the bottom edge of the mail piece. The catch-up section of the output-leveler module 12 ensures that each mail piece fed to the module 12 is properly timed and positioned with respect to the next preceding and succeeding mail pieces. This is done by computer by sensing the position of the mail piece, comparing the sensed position to a scheduled position, and making a corrective adjustment in the position of the mail piece by controlled operation of the servomotor, which either speeds up or slows down the mail piece accordingly. This type of catch-up mechanism is described in U.S. Patent Application Serial No. 07/742,752, filed Aug. 9, 1991, by Wakamiya et al., entitled "Induction Subsystem for Mail Sorting System", which is hereby incorporated by reference, said application now abandoned.

The feeder module 10 includes a conveyor section 14 and a singulator section 16. Many of the operable components of both sections 14 and 16 are located above a cabinet 18 which houses the various drive mechanisms which operate both sections 14 and 16.

The cabinet 18 has an upper planar surface 20 or counter top on which a conveyor belt 22 moves from right to left as an endless loop on pulleys mounted in the cabinet 18. The upper run of the belt 22 lies on the surface of the counter top 20. Openings 21 and 23 are provided in the counter top 20 for the belt 22 to pass therethrough so the lower rear of the belt 22 moves under the surface of the counter top 20.

A mail tray is pivotally connected to a platform 25 located within the cabinet 18, as shown in FIG. 1(*a*). The platform contains a vibrating motor 27 which, when activated causes the platform to vibrate on resilient supports 25*a*. A fluid pressure cylinder, such as an air cylinder 26 is connected to the platform 25 at one end and at the other end an extendable arm 26*a* driven outwardly by fluid pressure is connected to the underside of the mail tray 24. The platform 2 includes two vertical supports 27 and 29 which extend upwardly therefrom through openings formed in the counter top 20. The mail tray includes hinges 28 which are pivotally connected to the support arms so that when the air cylinder 26 is actuated the mail tray tilts upwardly to about a 20° orientation. The vibrating motor 27 is of any conventional construction such as the type which includes an eccentric weight which is rotated by an electric motor. The vibrating motor 27 and the air cylinder 26 can be controlled by a foot tredle 18*a* located on the floor in front of the cabinet 18 where an operator would be standing to place a stack of mail in the mail tray 24.

The operator places a stack of mail in the mail tray 24 with the mail pieces being faced to be compatible with an optical reader. For example, the bottom edge of each mail piece rests on the bottom plate 24*a* of the mail tray 24, while one of the side edges of the mail piece rests against the side plate 24*b* of the mail tray. The operator then steps on the foot tredle 18*a* to move it from a neutral position to a first position at which position the air cylinder 26 drives the lift-up arm 26*a* which tilts the tray 24 up about 20°. Once tilted up, the operator pushes the foot tredle 18*a* to a second position which turns on the vibration motor 27 which cause the platform 25 and thus the tray 24 to vibrate. Vibration edge-references the leading edge and the bottom edge of the mail pieces against the bottom plate 24*a* and side plate 24*b* of the tray 24.

After it is determined that the stack of mail in the tray 24 is edge-referenced, the operator moves the tredle 18*a* back to the first position whereupon vibration stops, and then back to the neutral position whereupon the tray 24 is lowered to its original flat position. The edge-referenced mail stack 30 is then pushed by hand towards a previously edge-referenced mail stack 32 which is being fed to the singulator 16. The mail stack 30 in the tray 24 can be added to the mail stack 32 being fed to the singulator, without interruption of mail delivery, in a manner to be described below.

Figure 3:
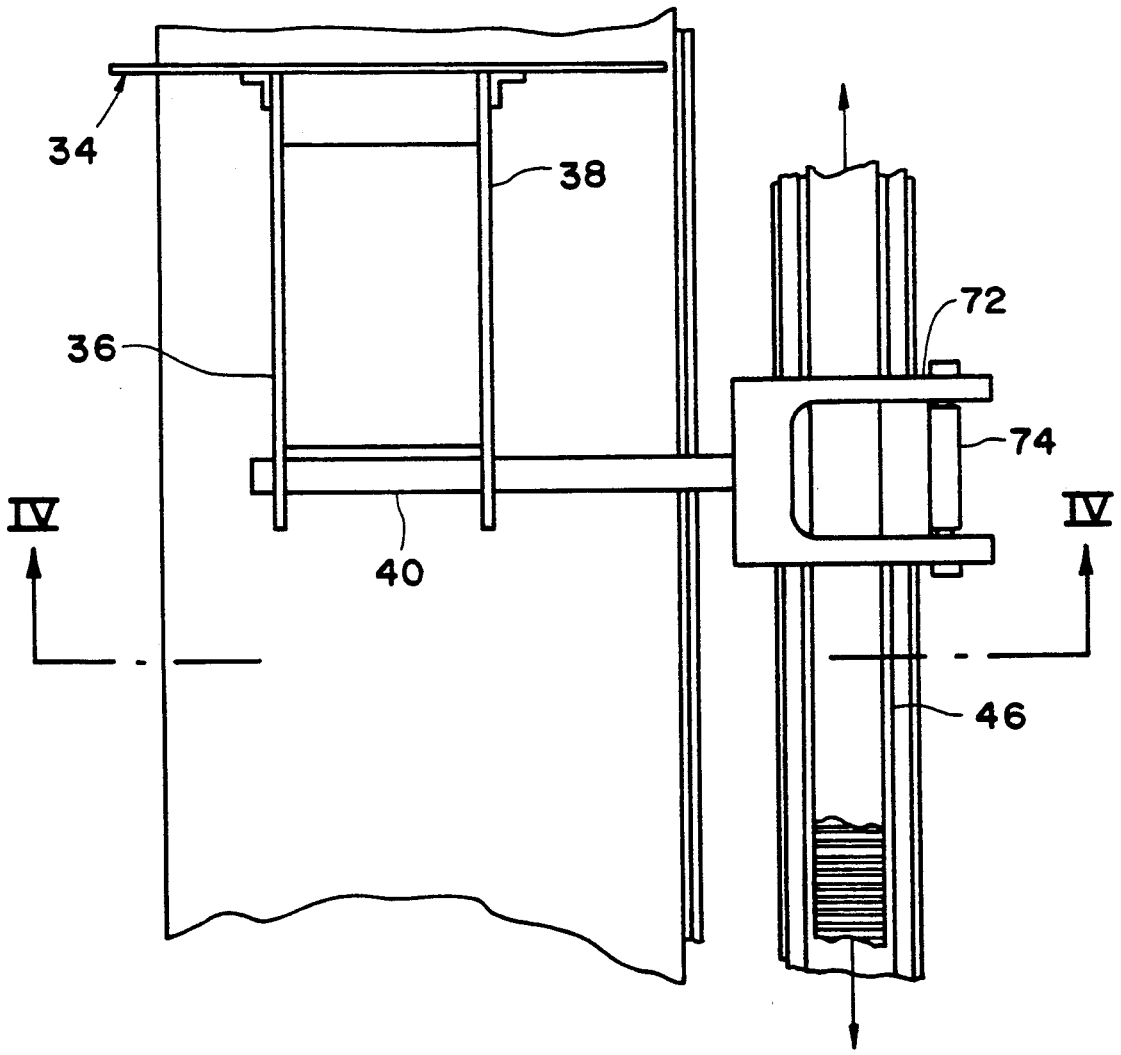
FIG. 3 is an enlarged, top view of a portion of the automatic feeder module of FIG. 1.
Figure 4:
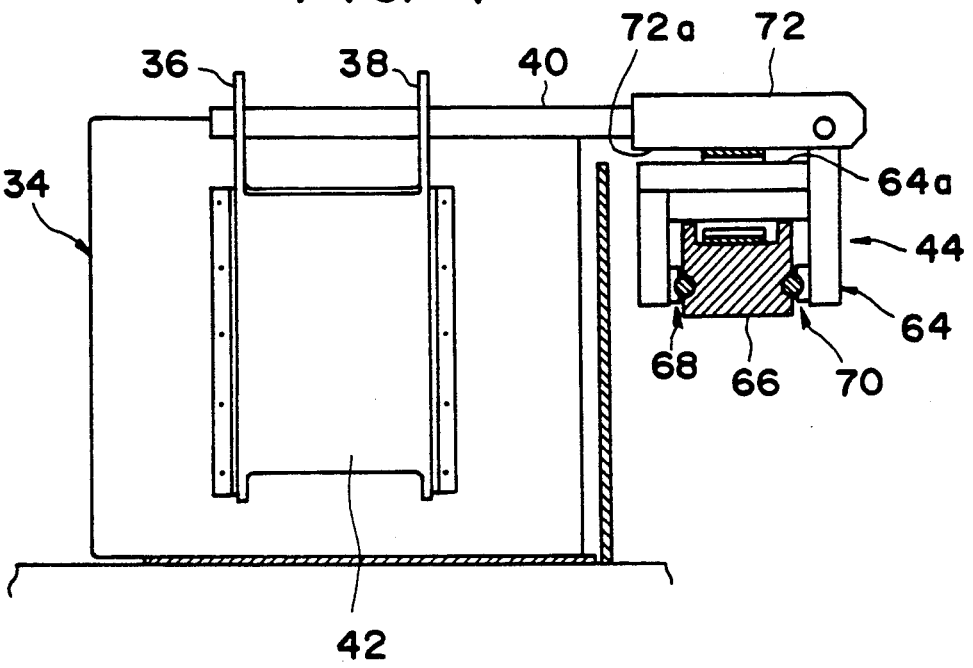
FIG. 4 is a sectional view taken along line IV—IV of FIG. 3.
Figure 5:
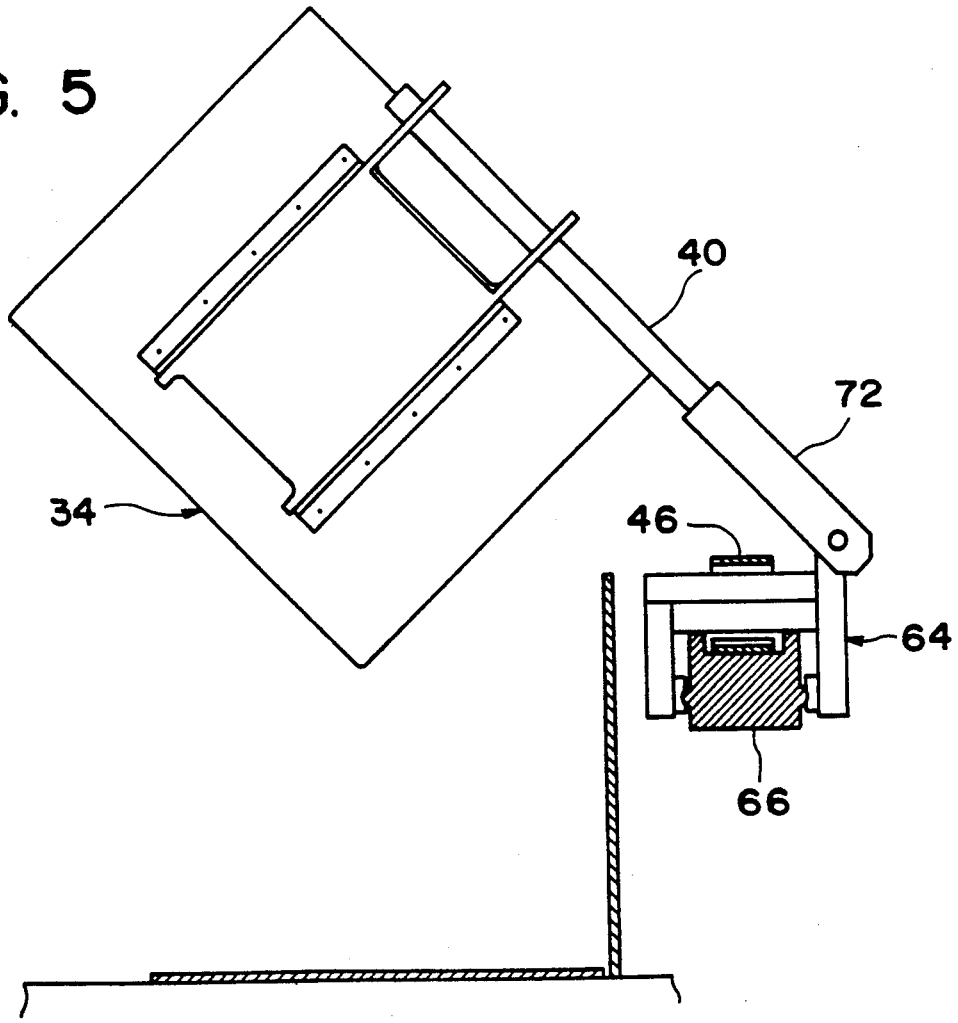
FIG. 5 is a view similar to FIG. 4, except with the drive plate 34 in the pivoted-upward position.

The conveyor belt 22 is driven at the same speed, by the same motor, as a drive plate 34 which has a forward side and a rearward side. Referring also to FIGS. 3-5, the drive plate 34 has a pair of support arms 36 and 38 connected to the rearward side of the plate 34. The support arms 36 and 38 have aligned holes in upper end portions thereof into which a support shaft 40 is press fit to be fixedly connected thereto. The support arms 36 and 38 have an integrally formed and interconnecting sloping plate 42 against which the edge-referenced mail stack 30 in the mail tray 24 can be pushed by the operator when it is desired to add more mail to the mail stack 32 on the forward side of the drive plate 34.

Figure 1A:
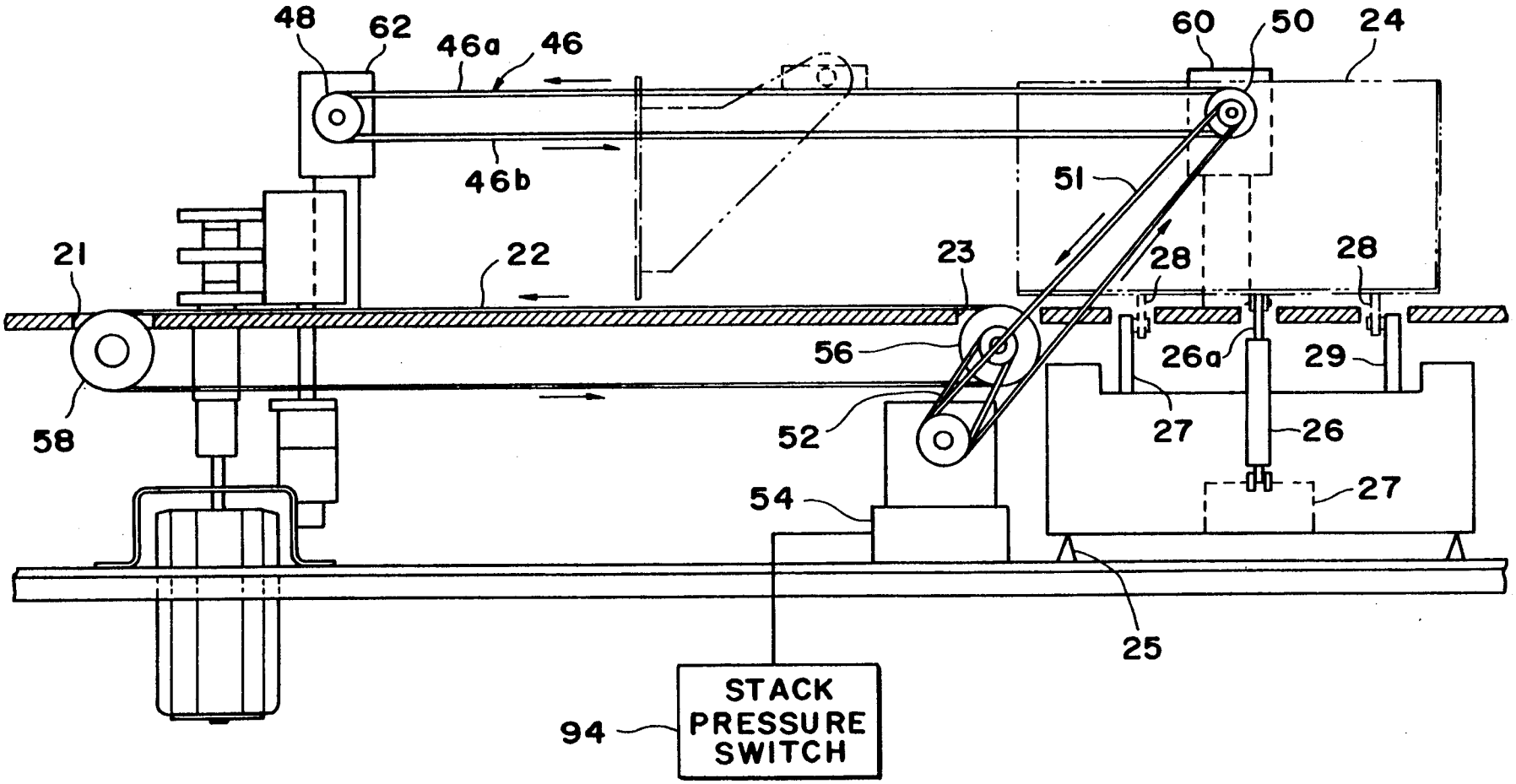
FIG. 1*a* is a side elevational view of the automatic feeder module of FIG. 1, inside the cabinet, and simplified for illustration.
Figure 2:
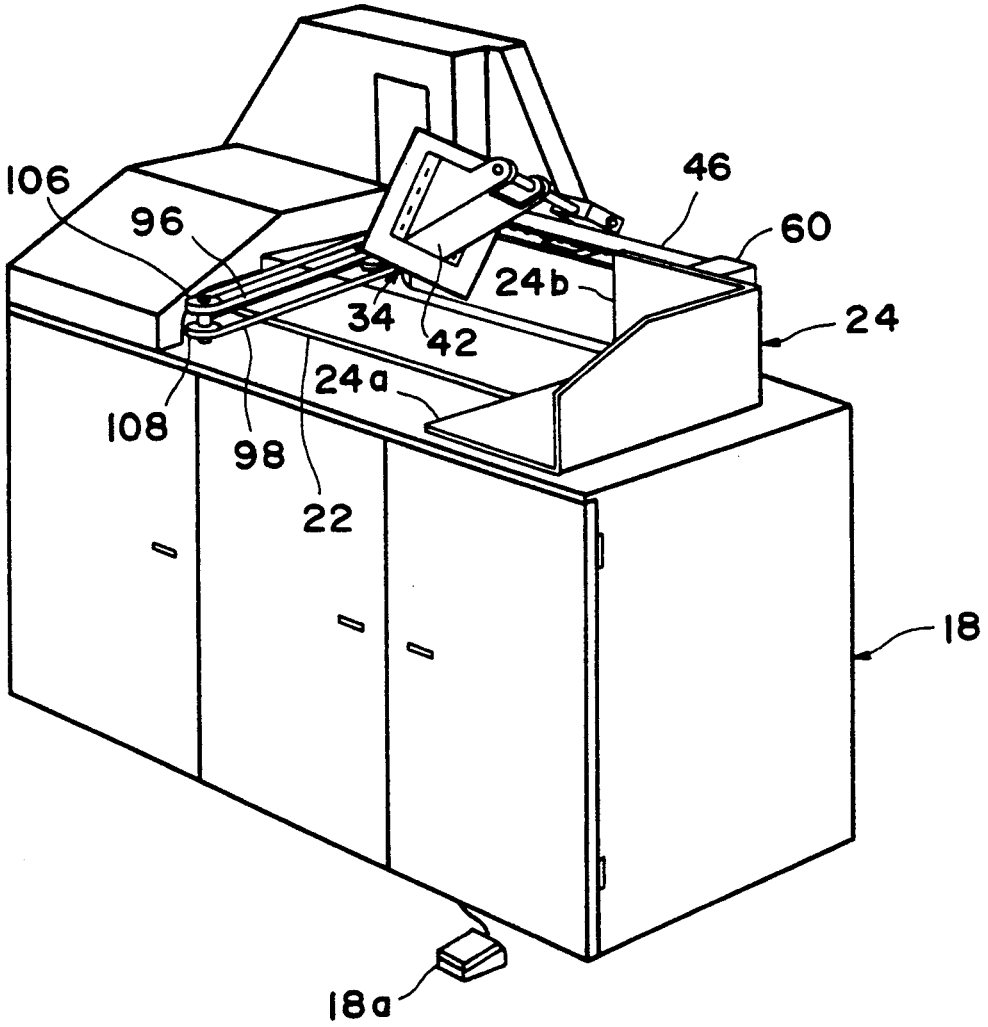
FIG. 2 is another perspective view of the automatic feeder module of FIG. 1.

As mentioned above, the operator at first pushes the edge-referenced mail stack 30 from the mail tray 24 up against the sloping plate 42 on the rearward side of the drive plate 34. Then, the operator lifts the drive plate 34 upwardly while pushing the mail stack 30 to be added forwardly towards the existing stack 32. Pivotal upward motion of the drive plate 34 is facilitated by a pivotal connection to a support plate drive mechanism. The drive mechanism 44 includes a timing belt 46 running between two end pulleys 48 and 50 (FIG. 1*a*) so as to have an upper run 46*a* which moves forwardly towards the singulator 16 and a lower run which moves rearwardly towards the mail tray 24. The timing belt 46 is driven by a timing belt 51 which is driven by an electric motor 54. The electric motor 54 also drives the conveyor belt 22 which runs between the two rollers 56 and 58, through a second timing belt 52. The output pulleys of the motor 54 and selected so that the belts 22 and 46 are driven at the same speed. The motor 54 may also be coupled to achieve a desired conveyor speed.

Since the pulleys 48 and 50 are above the cabinet, a suitable housing 60 and 62 is provided for each as a safety measure.

The support shaft 40 of the drive plate 34 is carried by a car 64 which is driven by the belt 46 along a track 66. The track has a pair of rails 68 and 70 disposed on opposite sides thereof, which cooperate with rollers located inside the car 64 to support and guide the car 64 for linear motion along the track 66. Other suitable guide means may be employed. An upper support 72 is pivotally mounted by a pivot pin 74 to a side of the car 64 which is the most distant side from the drive plate 34.

The belt 46 has its upper run 46*a* pinched between an upper surface 64*a* of the car 64 and a lower surface 72*a* of the support 72, thus pinching the upper run of the belt between the two surfaces so that as the upper run of the belt 46 moves forwardly towards the singulator, the car 64 is driven forwardly by the belt. The lower run of the belt 46 travels freely on an upper surface of the track 66.

When the drive plate 34 is lifted upwardly as shown in FIG. 5 the upper run of the belt 46 is no longer pinched between the support 72 and the car 64. Thus, the belt 46 can continue to be driven by its drive means along with the conveyor belt 22 without further advancing the drive plate 34.

With the drive plate 34 lifted upwardly as shown in FIG. 5, and while the operator is holding the new edge-referenced mail stack 30 against the original stack 32, the plate 34 is lifted upwardly sufficient to avoid contact with the upper edges of either mail stack. Then, the drive plate 34 is pushed rearwardly so that the car 64 slides along the track 66 until the drive plate is at a position behind the new, combined stack. Then, the drive plate 34 is lowered so that the new, combined stack of mail is all on the forward side cf the drive plate 34.

Referring to FIGS. 6–9, the singulator section 16 includes an anti-doubler roller 76 which is rotatable about an axis C. The rotation axis C is movable radially outwardly to accommodate larger pieces of mail.

Pick-off belts 78, 80 and 82 normally contact the anti-doubler roller 76. The anti-doubler roller 76 is driven by an air motor 124 which drives the anti-doubler roller 76 in the counterclockwise direction shown in FIG. 6. However, the pick-off belts 78, 80 and 82 which contact the anti-doubler roller 76 are driven in the counterclockwise direction by an electric servomotor which has a torque which is much greater than the torque of the air motor which drives the anti-doubler roller 76. Thus, when the pick-off belts 78, 80 and 82 are in contact with the anti-doubler roller 76, and the pick-off belts are driven in the counterclockwise direction by their servomotor drive source, the anti-doubler roller 76 is forced to rotate in the clockwise direction by virtue of the frictional engagement of the belts 78, 80 and 82 with the outer surface of the roller 76.

The pick-off are carried by rollers 84 and 86. Roller 84 is mounted on a shaft 85 which extends through the counter top 20 and is driven by the servomotor 88 to rotate about a fixed rotational axis A. The roller 86 is mounted on a shaft 104 which swings above the counter top 20 and is rotatable about an axis B. Swing arms 90 and 92 support the shaft 104 and one end and are carried by the roller 84 to permit the roller 86 to swing in the clockwise direction of FIG. 6.

A stack pressure switch 94, such as a Hall effect sensor, is mounted in proximity to the pick-off belts so as to sense the amount of pressure exerted by the mail stack 32 against the pick-off belts 78, 80 and 82. The stack pressure switch 94 includes a stationary portion 94*a* mounted on the counter top 20 and a movable portion 94*b* on or mounted between the swing arms 90 and 92 of the drive belt assembly. While stack pressure switch 94 is preferably a magnetic switch, such as a Hall effect sensor, any pressure sensitive switch would be suitable. The switch 94 senses pressure of the mail against the pick off belts 78, 80 and 82. The switch 94 thus turns on and off the DC electric motor 54 shown in FIG. 1*a* so that when the pressure reaches a certain level, the motor 54 is turned off. When the pressure falls below the predetermined level, the motor is turned back on. When the motor 54 is turned on, the pressure will increase as the mail stack 32 is pushed against the pick-off belts.

A spring restoring force is generated by secondary pick-off belts 96 and 98 which are driven by pulleys 100 and 102 mounted on the support shaft 104 of the pulley 86. The opposites end of the belts 96 and 98 are supported by pulleys 106 and 108 which extend upwardly from the counter top 20 on a suitable support shaft. As the mail stack 32, which is delivered to the singulator 16 by the conveyor section 14, causes the roller 86 to swing clockwise, the belts 96 and 98 swing in a counterclockwise direction. Since the belts 96 and 98 are elastic, a restoring force is generated.

The anti-doubler roller 76 is preferably made to have a soft spongy outer surface so as to provide good frictional engagement with both the pick-off belts and a piece of mail passing therebetween. The roller 76 rotates about the rotation axis C, but the rotation axis C can be displaced laterally to accommodate larger pieces of mail between the pick-off belts and the outer surface of the anti-doubler roller 76. To accommodate this movement, a slot 110 is formed in the counter top 20 so that the support shaft 112 of the anti-doubler roller 76 can be displaced laterally. In order to facilitate lateral displacement of the support shaft 112, the shaft 112 is mounted on a pair of swing arms 114 and 116 which are interconnected through a vertical block 118. The vertical block 118 is connected to the two swing arms 114 and 116 through any suitable means, such as threaded fasteners.

The upper swing arm 114 is pivotally mounted to the lower surface of the counter top 20 through a shoulder bolt 120 and bearing 122 to permit pivotal motion about a pivot axis D. The lower swing arm 116 carries an air motor 124 which has a rotary output pinion 126 interconnected to a drive pinion 128 of the support shaft 112. A timing belt 130 interconnects the two pinions 126 and 128 so that the air motor imparts rotary motion in the anti-doubler roller 76. Air circulates through the motor through input line 132 and output line 134. The air motor is preferably a 50 psi, six cubic feet per minute motor which delivers a certain amount of torque to the shaft 112.

Figure 6:
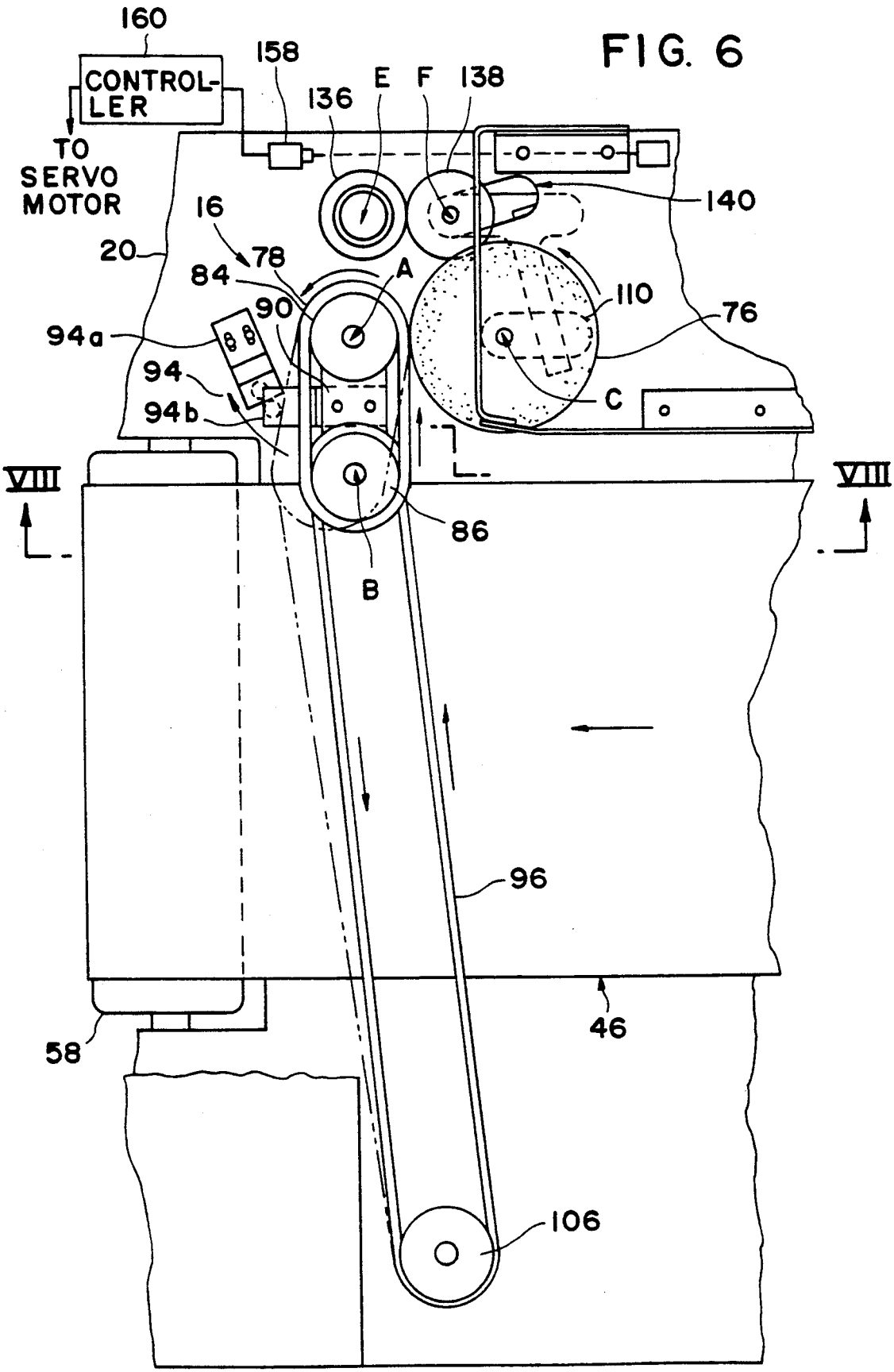
FIG. 6 is an enlarged top view of the singulator section of the automatic feeder module of FIG. 1.

The air motor 124 causes the anti-doubler roller 76 to rotate counterclockwise as viewed in FIG. 6. However, the torque delivered by the air motor 124 is not sufficient to overcome the torque imparted on the anti-doubler roller 76 by the pick-off belts, which are driven through a servomotor 88 coupled to pulley 84. The servomotor is turned on and off by a computer control system which determines that the timing for a mail piece to be delivered to pinch take away rollers 136 and 138.

Friction between the pick-off belts and an envelope or piece of mail is higher than the friction between the anti-doubler roller 76 and the envelope. Thus, since the torque of the servomotor 88 is greater than the torque of the air motor 124, by a substantial amount, the mail piece is delivered to the pinch take away rollers 136 and 138. As the mail piece passes between the pick-off belts 78, 80 and 82 and the anti-doubler roller 76, the frictional engagement between the anti-doubler roller 76 and the pick-off belt is broken by the mail piece, so that the anti-doubler roller 76 can rotate in its normal counter-clockwise driven direction. In the event that the two pieces of mail pass between the pick-off belts 78, 80 and 82 and the anti-doubler roller 76 at the same time, the friction between the two envelopes is low and the counterclockwise rotation of the anti-doubler roller 76 will cause one of the two pieces of mail to be kicked rearwardly away from the pinch take away rollers. This ensures that a single piece of mail is delivered at one time.

Pinch take away roller 136 is driven and has a rotation axis E which is positionally fixed, whereas the pinch take away roller 138 is an idler and has a rotation axis F which is capable of lateral displacement in order to accommodate mail pieces of greater thickness. In order to accommodate this lateral displacement, an opening 140 is formed in the counter top 20 so as to allow a support shaft 142 of the idler roller 136 to extend through the opening 140.

The support shaft 142 is carried by a lever arm 144 which has a long portion 144*a* and a short portion 144*b* disposed at an angle to the long portion 144a. The short portion 144b is fixedly connected to a sliding bar 146 which slides within a housing 148. The housing 148 is fixedly connected to the lower surface of the counter top and thus the lever arm 144 is slidably connected to the counter top.

The long portion 144a of the lever arm 144 extends to be substantially parallel to swing arm 114. In the normal position of the pulley 138 and the anti-doubler roller 76, there is a small gap between opposing surfaces of the long portion of the lever arm 144 and a bearing 154 mounted on the shaft 112. When a piece of mail pushes the anti-doubler roller 76 outwardly, the opposing surfaces of the bearing 154 and lever arm come together to close the gap until the opposing surfaces contact each other. Then, as the anti-doubler roller 76 is urged further outwardly, the bearing 154 pushes the lever 144 radially outwardly so as to pull the pinch take away roller 138 laterally outwardly. Thus, lateral displacement of the pinch take away roller 138 is designed to lag behind lateral displacement of the anti-doubler roller 76 so that there is no possibility of a loss of pinch take away contact between a piece of mail passing through the pinch take away rollers 136 and 138, resulting from a larger piece of mail entering the pick-off belt zone of the singulator.

When the anti-doubler roller 76 begins to move laterally outwardly, it moves against a slight bias generated by a first dashpot 150 which is supplied with air to create about 3 psi bias on an arm 152 which contacts the block 118. This acts as both a shock absorber and a return biasing means so that the anti-doubler roller 76 returns to its normal position after passage of a large piece of mail. A supplemental shock absorber 155, which is fixedly connected to the frame of the cabinet or to the underside of the counter top 20 so as to provide additional dampening of the anti-doubler roller 76 as it swings on the swing arms 114 and 116.

Figure 7:
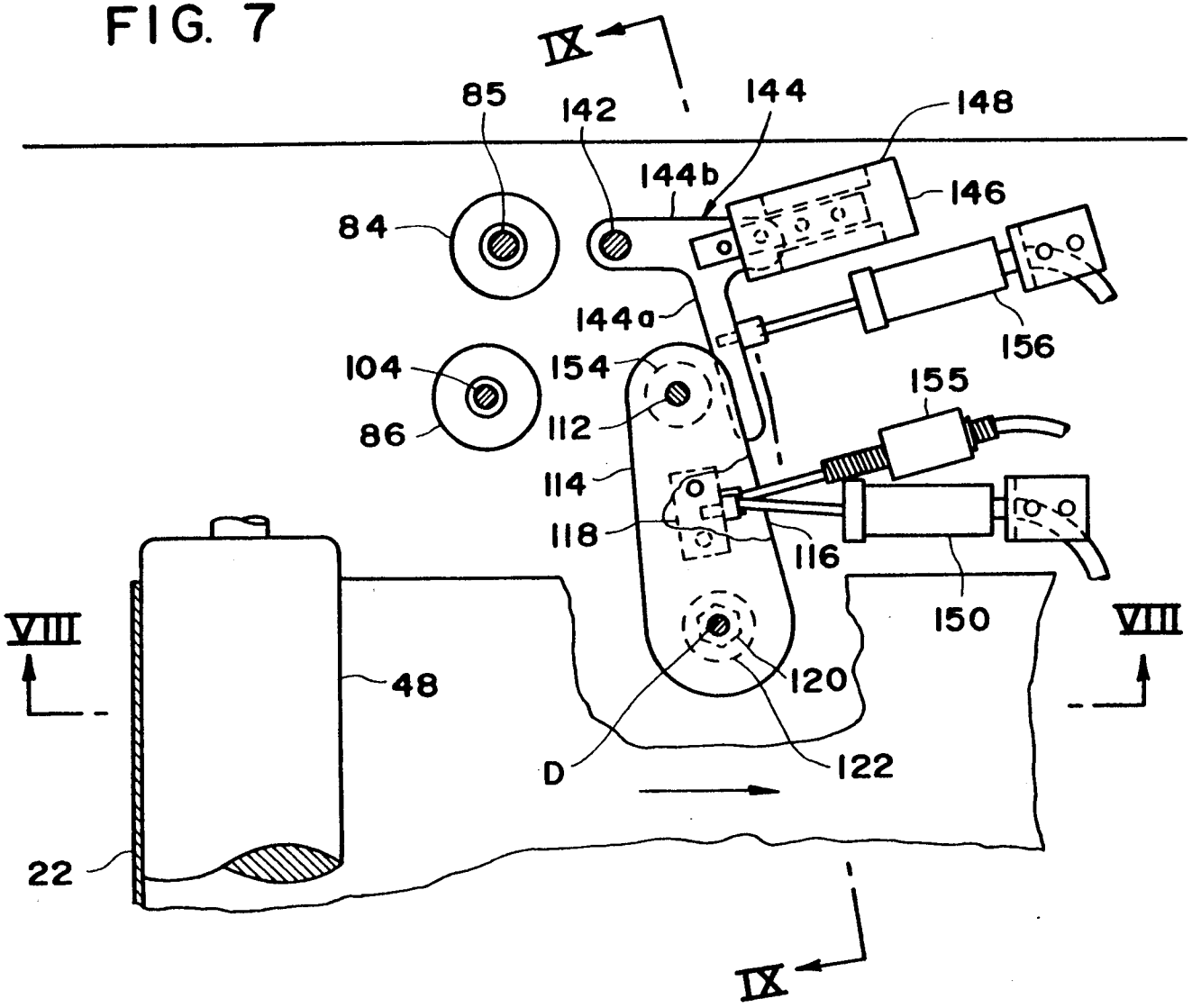
FIG. 7 is a sectional view taken along a horizontal plane just below the counter top of the automatic feeder module.
Figure 8:
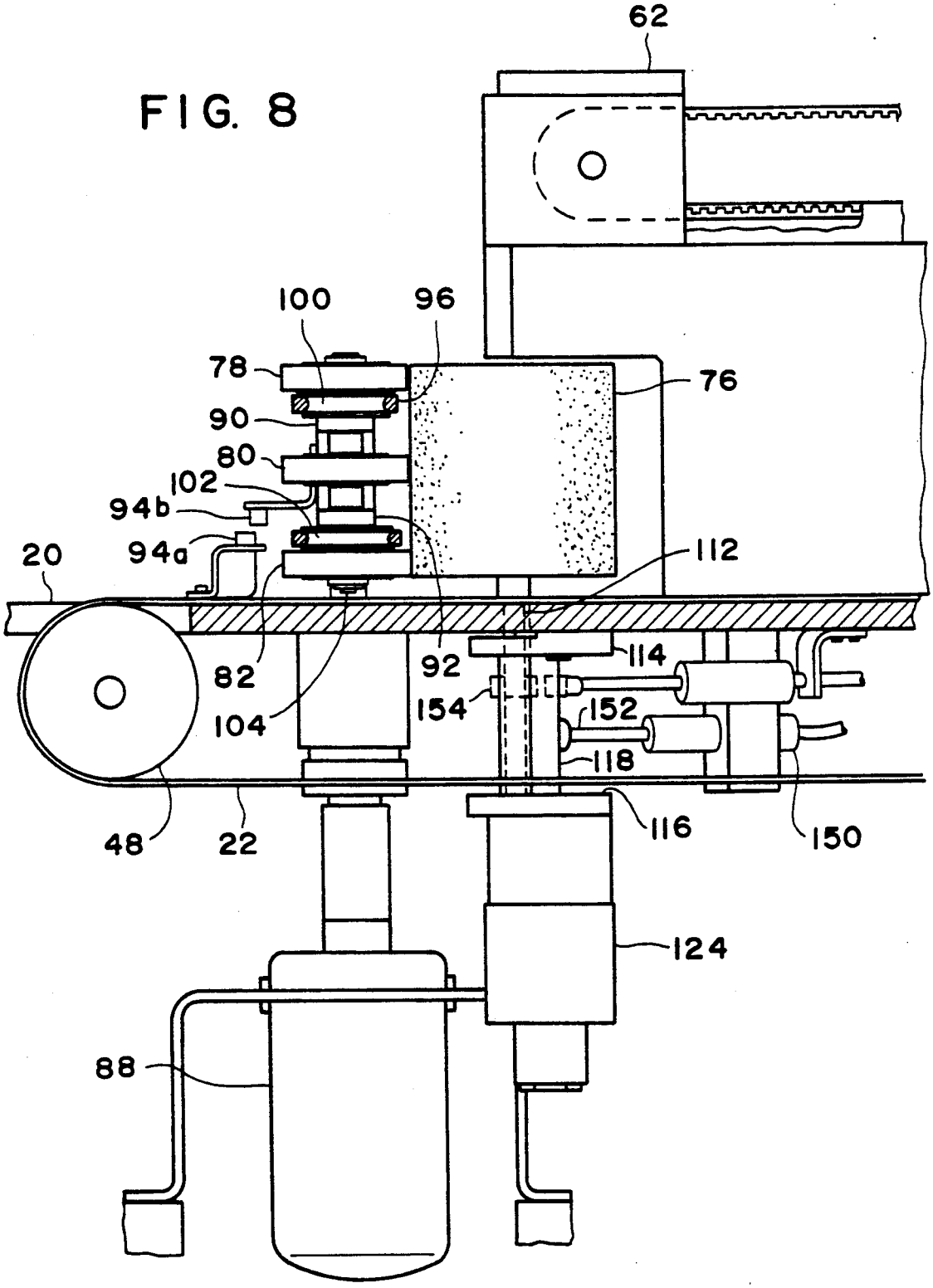
FIG. 8 is a sectional view taken along line VIII—VIII of FIGS. 6 and 7.
Figure 9:
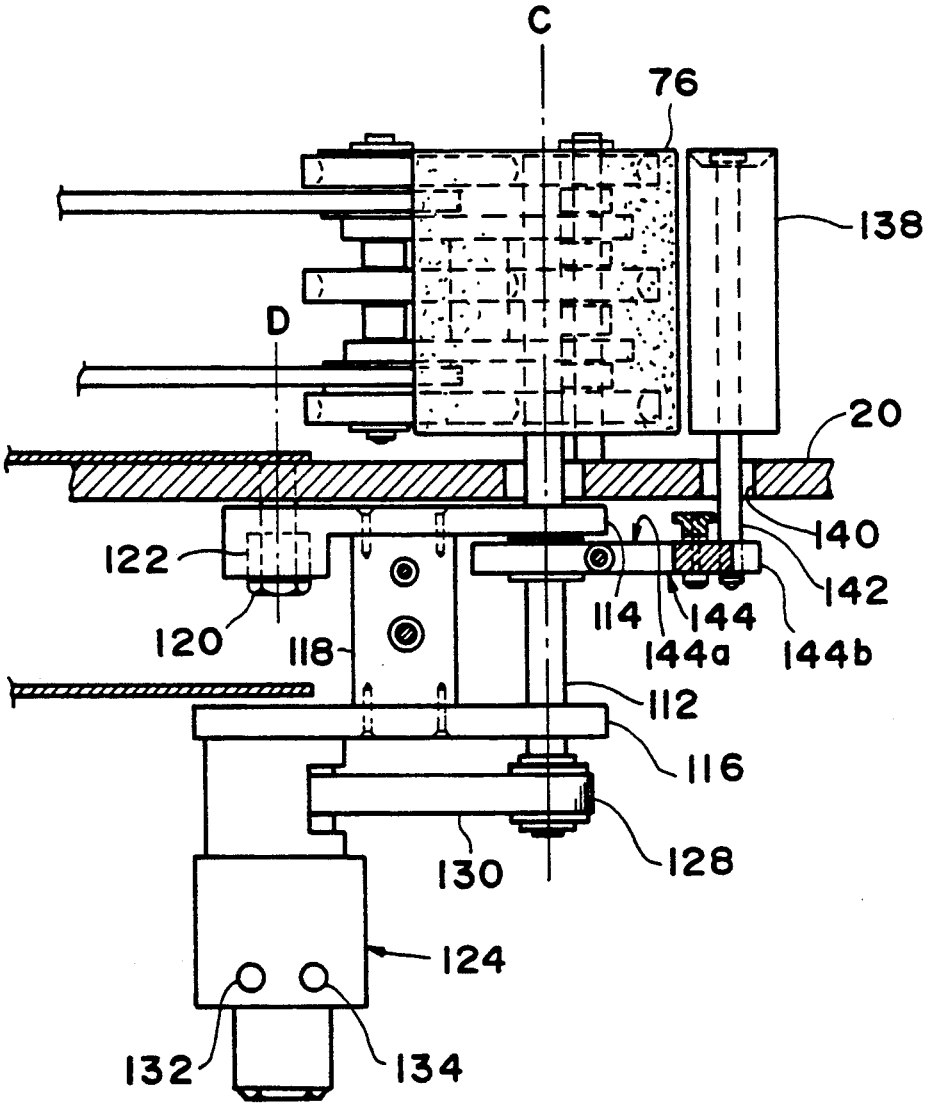
FIG. 9 is a sectional view taken along line IX—IX of FIG. 7.

Referring to FIG. 7, after the shaft 112 which supports the anti-doubler roller 76 has swung clockwise through a few degrees of rotation, the long portion 144a of the lever arm 144 contacts the bearing 154 provided on the support shaft 112. Further swinging movement of the shaft 112 pushes the lever arm 144 radially outwardly. A second dashpot 156 provides a biasing force which opposes this radial outward movement of the lever arm 144. The biasing force is greater than the biasing force generated by the first dashpot 150 and is, for example, about 23 psi.

Since the lever 144 is not connected to the swing arms 114 or 116, or to the shaft 112 or the bearing 154, the anti-doubler roller 76 can return to its original position even though a wide piece of mail is passing through the pinch take away rollers. Thus, the anti-doubler roller 76 returns to its original position before the pinch take away roller 138 returns to its original position after passage of a thick piece of mail. The higher biasing force generated by the dashpot 156 reflects the fact that a strong frictional engagement must be maintained at the pinch take away rollers to prevent slippage.

Biasing means other than dashpots 150 and 156 may be employed, such as compression springs, etc. Dashpots are preferable because the system uses an air motor and a single source of compressed air can be used to supply both the air motor and the dashpots. Also, the bias generated by the dashpots can be adjusted easily to provide the exact amount of necessary bias.

Referring to FIG. 6, a through beam sensor 158 detects when a leading edge of the piece of mail has passed through a beam supplied by the through beam sensor 158. This signal is supplied to a system controller 60 which sends a signal signal to the servomotor 88. Thus, the controller 160 sends a control signal to the servomotor 88. Thus, the controller 160 sends a control signal to the servomotor 88 to cause the servomotor to shut down when the leading edge of a piece of mail is passed through the through beam of the through beam sensor 158. A clock within the controller counts off a predetermined time interval before then sending a control signal to the servomotor 88 to power the servomotor once again, thereby driving the pick-off belt 78, 80 and 82 to deliver the next succeeding piece of mail to the pinch take away rollers 136 and 138.

The pinch take away rollers 136 and 138 are driven constantly through a drive belt (not shown) coupled to a separate drive motor (not shown). On the other hand, the servomotor 88 is driven intermittently to deliver individual pieces of mail to the pinch take away rollers on a precisely timed basis.

Through beam sensors are commercially available and one particularly suitable model is sold by Banner Engineering Corp. of Minneapolis, Minn. as a Model SM3E.

Numerous modifications and adaptations of the present invention will be apparent to those so skilled in the art and thus, it is intended to cover all such modifications and adaptations which fall within the true spirit and scope of the invention.

What is claimed is:

1. An automatic feeder module for a mail sorting system comprising:

a cabinet having first and second ends and an upper planar surface;

a conveyor belt having an upper run travelling along the upper surface of the cabinet;

a drive plate linearly driven along the conveyor belt at the same speed as the conveyor belt and having a forward side and a rearward side;

means for driving the conveyor belt and the drive plate at the same speed;

a singulator assembly including pick-off means against which a stack of mail is pressed by the drive plate and the conveyor belt, and a stack pressure switch for turning the driving means on and off to maintain a predetermined stack pressure against the pick-off means; and a mail tray pivotally mounted at the first end of the cabinet on the upper surface thereof, and means for tilting and vibrating the mail tray when loaded with mail pieces, for edge-referencing the mail pieces on at least two edges of each mail piece.

2. An automatic feeder module according to claim 1, wherein the mail tray is pivotally mounted on a stand having a vibration motor disposed therein, and the tilting means comprises a fluid pressure cylinder having one end connected to the mail tray and an opposite end connected to the stand.

3. An automatic feeder module according to claim 2, wherein the fluid pressure cylinder is extendable to tilt the mail tray upwardly up to an angle of about 20°.

4. An automatic feeder module according to claim 3, wherein the mail tray includes a bottom plate, a first side plate along which the mail tray is pivotally connected to the stand, and a second side plate disposed at a rearmost edge of the bottom plate, the bottom plate and two side plates being mutually orthogonal.

5. An automatic feeder module according to claim 1, wherein the conveyor belt is supported on two conveyor rollers, and the driving means comprises a motor coupled to one of the two conveyor rollers.

6. An automatic feeder module for a mail sorting system comprising:

a cabinet having first and second ends and an upper planar surface;

a conveyor belt having an upper run travelling along the upper surface of the cabinet;

a drive plate linearly driven along the conveyor belt at the same speed as the conveyor belt and having a forward side and a rearward side;

means for driving the conveyor belt and the drive plate at the same speed;

a singulator assembly including pick-off means against which a stack of mail is pressed by the drive plate and the conveyor belt, and a stack pressure switch for turning the driving means on and off to maintain a predetermined stack pressure against the pick-off means;

wherein the driving means further includes a drive belt running between two drive belt pulleys, wherein the motor is coupled to one of the two drive belt pulleys to drive the drive belt at the same speed as the conveyor belt;

means for operatively engaging the drive plate with the drive belt; and means for releasing the drive plate from the drive belt wherein the drive means further includes a guide track disposed parallel tot the conveyor belt, and said operatively engaging means includes a car slidably mounted on the guide track and having an upper surface, a pivotal mounting member pivotally connected to the car along a longitudinal edge thereof, a support having one end connected to the mounting member and an opposite end connected to the drive plate, the mounting member having a lower surface, an upper run of the drive belt being pinched between the upper surface of the car and the lower surface of the mounting member so that the car is driven by the drive belt, whereby when the mounting member is pivoted upwardly, the drive belt is disengaged from the car so that the car can be moved rearwardly along the track.

7. An automatic feeder module for a mail sorting system comprising:

a cabinet having first and second ends and an upper planar surface;

a conveyor belt having an upper run travelling along the upper surface of the cabinet;

a drive plate linearly driven along the conveyor belt at the same speed as the conveyor belt and having a forward side and a rearward side;

means for driving the conveyor belt and the drive plate at the same speed;

a singulator assembly including pick-off means against which a stack of mail is pressed by the drive plate and the conveyor belt, and a stack pressure switch for turning the driving means on and off to maintain a predetermined stack pressure against the pick-off means;

a pair of pinch take away rollers, and the pick-off means comprises a first pulley having a fixed rotational axis and support shaft coupled to a servomotor, a second pulley having a rotational axis, the second pulley being supported on swing arms coupled to the first pulley so that the rotation axis of the second pulley swings about the rotation axis of the first pulley, and the stack pressure switch comprises a stationary component mounted adjacent the swing arms and a movable component mounted on the swing arms and cooperating with the stationary component when moved into juxtaposition thereto to provide a signal indicative of the pressure exerted on the swing arms due to the stack of mail which presses against primary pick-off belts carried by the first and second pulleys, said automatic feeder module further comprising a rotatable tension pulley having a fixed rotation axis, and secondary pick-off belts running from the tension pulley to the second pulley;

wherein the singulator assembly includes an anti-doubler roller normally in contact with the primary pick-off belts at the first pulley and being rotatable about a rotation axis by an air motor in a direction opposite a direction of rotation of the first pulley and being swingable about a swing axis to provide lateral displacement of the anti-doubler roller;

wherein the air motor produces a torque in one direction which is less than a torque generated by the servomotor in the opposite direction, whereby the anti-doubler pulley is forced to rotate in a direction opposite the direction of torque imparted by the air motor so long as the anti-doubler roller in contact with the primary pick-off belts.

8. An automatic feeder module according to claim 7, where the anti-doubler roller is mounted on a shaft which is supported on a swing arm, and the swing arm is biased by contact with a first dashpot to be oriented in a normal position.

9. An automatic feeder module according to claim 8, wherein one of the pair of pinch take away rollers is an idler roller mounted on a support shaft, and wherein the support shaft is slidably mounted under the counter top and connected to a lever arm, the lever arm being actuated by contact with a support shaft of the nti-doubler pulley after swinging of the anti-doubler pulley after swinging of the anti-doubler roller through an arc of predetermined length.

10. An automatic feeder module according to claim 9, further comprising a second dashpot, having a stronger bias than the first dashpot and being in contact with the lever arm to bias the idler pulley of the pinch take away pulleys in a normal position.

* * * * *